United States Patent [19]

Teoli

[11] 4,236,459

[45] Dec. 2, 1980

[54] DEPRESSED CENTER CAR

[75] Inventor: Anthony Teoli, Pointe Claire, Canada

[73] Assignee: The Youngstown Steel Door Company, Cleveland, Ohio

[21] Appl. No.: 914,509

[22] Filed: Jun. 12, 1978

Related U.S. Application Data

[63] Continuation-in-part of Ser. No. 699,312, Jun. 24, 1976, abandoned.

[51] Int. Cl.[3] ..... B61D 17/00

[52] U.S. Cl. ..... 105/406 R; 105/244; 105/364; 105/247; 295/41

[58] Field of Search ..... 105/406 R, 406 A, 364, 105/216, 244, 247, 217; 295/41, 42; 296/1 A, 178, 187, 188, 204, 181, 203; 280/781, 784, 789

[56] References Cited

U.S. PATENT DOCUMENTS

| | | | |
|---|---|---|---|
| 1,474,814 | 11/1923 | Campbell | 105/406 R X |
| 1,508,123 | 9/1924 | Ramsey | 295/41 X |
| 1,754,744 | 4/1930 | Edmunds | 105/217 |
| 1,962,497 | 6/1934 | Francis | 280/781 X |
| 2,056,654 | 10/1936 | Edmunds | 295/41 X |
| 3,713,400 | 1/1973 | Teoli | 105/406 R |

*Primary Examiner*—John J. Love
*Assistant Examiner*—D. W. Underwood
*Attorney, Agent, or Firm*—John H. Mulholland

[57] ABSTRACT

An open top gondola railway car of depressed center design having stub sills and an end panel at each end of the car body which slopes outwardly and upwardly from an intersection with a generally permanently closed bottom having horizontal plate portions and at least one centrally located depressed curved portion in cross-section. Wheeled multi-axle trucks adjacent each end are provided with the horizontal plate portions extending over them. An upwardly directed step portion located intermediate the ends of the curved portion and reinforced openings having a smoothly curved perimeter in the horizontal plate portions located over the wheels, provide an increase in the clearance distance between the bottom and any concave or convex contoured portion of track upon which the car is located. The openings may be circular with rings or flanged conical members bolted to them to provide the reinforcing. The sloped ends have support sheets directing lading forces exerted on the ends to the stub sills.

9 Claims, 10 Drawing Figures

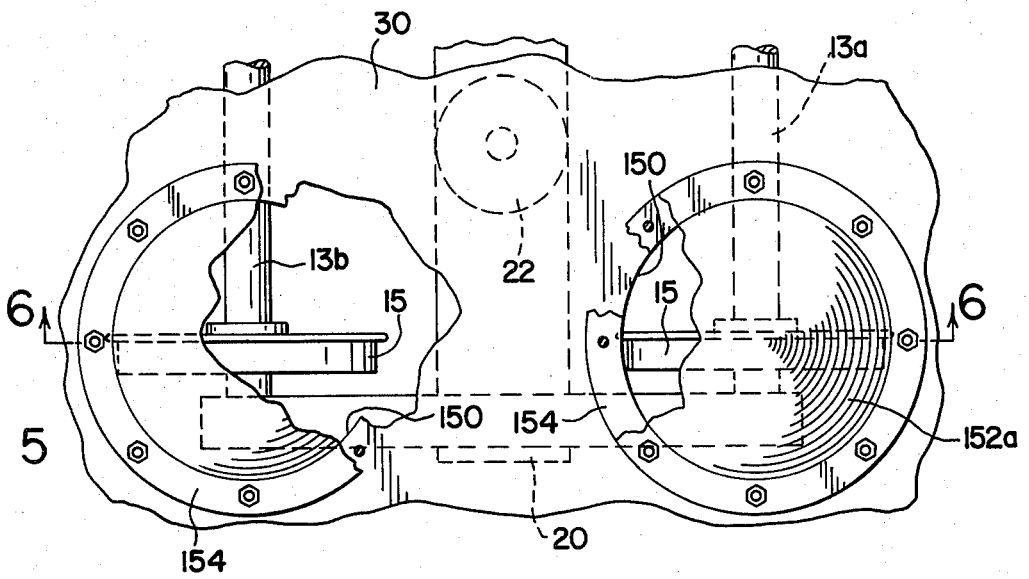
FIG. 5
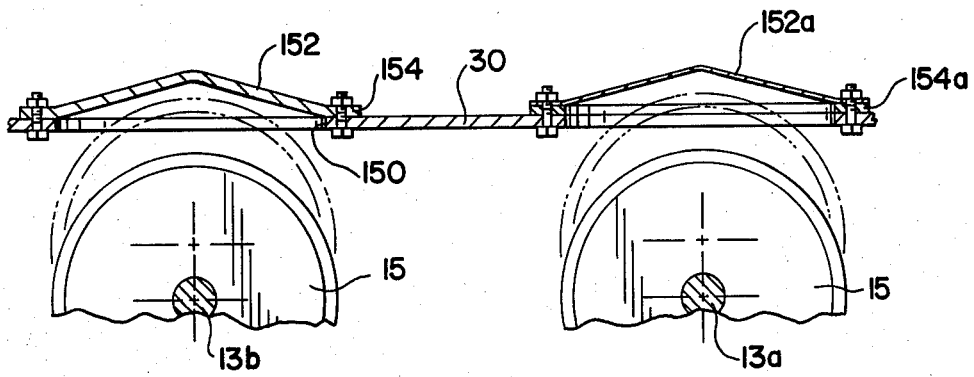
FIG. 6
FIG. 7
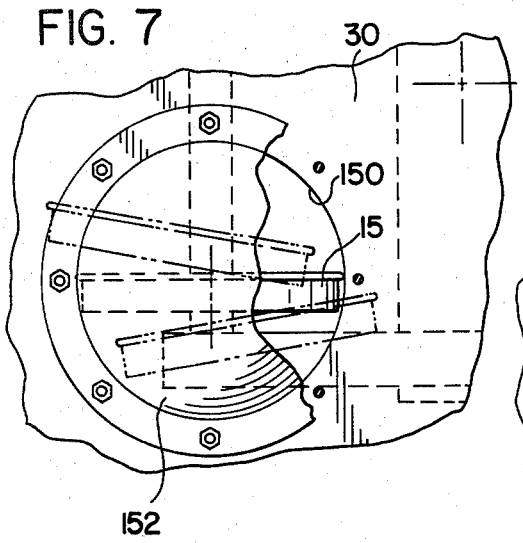
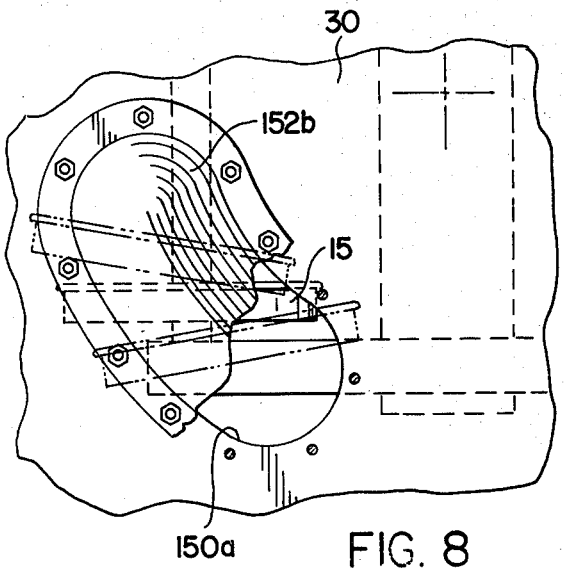
FIG. 8

DEPRESSED CENTER CAR

CROSS REFERENCE TO RELATED APPLICATION

This application is a continuation-in-part of U.S. patent application Ser. No. 699,312 filed June 24, 1976 by Anthony (NMI) Teoli and entitled Improved Depressed Center Car, now abandoned in favor of U.S. application Ser. No. 903,046 filed May 5, 1978.

BACKGROUND OF THE INVENTION

This invention relates to open top gondola railway cars of depressed center design into which bulk lading is loaded and unloaded from the open top. Bulk loading is usually accomplished by "flood loading" with the car in motion and unloading is usually accomplished by rotary dumping of the car. This type of gondola car is normally employed to carry bulk materials such as coal, sand, gravel, ore or the like. Recent developments in rotary dump gondola cars have permitted a relatively low center of gravity because of the depressed center or "bathtub" design which supports the car body on stub end sills and permits the curved bottom portion of the car body to extend downwardly between the trucks with horizontal plate bottom portions extending over the trucks. These cars generally have been provided with a parabolic or a concave inner shape on the top surface of the curved bottom portion sheet when viewed in cross-section and a convex outer shape on the lower or bottom surface of the curved bottom sheet when viewed in cross-section.

An example of a railway car of this general type is shown in U.S. Pat. No. 3,713,400, issued Jan. 30, 1973, to Anthony Teoli, the inventor of the instant application. Also pertinent to the background of the invention is U.S. Pat. No. 3,817,189, issued June 18, 1974, to William Dale Bailey, and the references cited in these patents and the above-referenced parent application.

The Teoli patented car has been successful service in Canada, but is not readily adaptable to U.S. service because of the relatively small size of rotary dumping apparatus used by United States railroads and shippers. Therefore, it is necessary to design and provide shorter cars for service in the United States with existing rotary dumping equipment and with equipment of current design still to be manufactured and put into use. Such a novel design was disclosed in U.S. application Ser. No. 699,312, referenced above, of which the instant application is a continuation-in-part. The new material of this application relates to a novel stepped structure of the curved bottom portion and clearance openings in the horizontal plate portions and shear plates over the wheels whereby an increase in the clearance distance between the car and any concave or convex contoured portion of track upon which the car is located is achieved with a minimum loss of car capacity.

SUMMARY OF THE INVENTION

The present invention provides an open topped gondola railway car of the depressed center type which is shorter in length than the cars currently being made while retaining roadability due to a low center of gravity. This is accomplished with a minimum loss of cubic volume within the car while protecting the top valves, fittings and reservoirs of the brakes and the safety appliances. On certain tracks having extreme concave or convex contours, however, clearances of the wheels with respect to the shear plates and of the depressed center portion with respect to the tracks by the car described in the parent application are insufficient. The instant invention provides an increase in these clearance distances to alleviate this problem by providing a stepped central portion of the depressed center portion and reinforced openings in the horizontal plate portions or shear plates over the wheels.

The provision of this increased clearance was complicated because it is necessary to consider the flexibility and dynamic tracking stability of the car. The ability to accommodate a certain amount of racking and weaving is highly desirable and normally is allowed for in car design. This takes shocks and vibrations from the trucks of one end and dampens them before they are transferred to the other end. One of the advantages that results from this is that there is very little wheel lift on a car having this flexibility. The problem of wheel lift is particularly severe when the car is empty, as it is for example in unit train service on the return trip from the discharge end of the line to the loading end. Wheel lift is undesirable because it decreases the wear life of the car wheels and causes maintenance and down time of the car. When used in unit trains, an open top gondola car often will have mileage in service of eight to ten times that of an average open top gondola car used in interchange service. Accordingly, it is important that wheel wear be minimized. Moreover, rocking and oscillating forces which occur in a car not properly designed for dynamic tracking stability can cause damage to the track surface, the truck components, and the car structure itself. Car derailment is another factor that must be considered as a definite threat from wheel lift.

In the past, it has been relatively standard for car designers to maintain a low center of gravity by lengthening and lowering the car. The instant invention provides a shortened car for standard rotary dumpers with increased track and wheel clearances while maintaining a maximum volume for lading in the car body. This has been done while retaining the basic ability of depressed center cars to provide dynamic tracking stability even without the use of special shock absorbing apparatus. The track clearance has been accomplished by providing the depressed center portion of the car bottom with an upwardly directed step portion located intermediate the ends of the curved portion to accommodate severe concave track contours. The horizontal plate portions of the car bottom or shear plates extend over the wheels and have openings in register with at least some of the wheels to accommodate severe convex and concave track contours. The openings may be circular with rings or flanged conical members bolted to the plates about their peripheries to provide reinforcing and to contain the lading within the car body.

BRIEF DESCRIPTION OF THE DRAWINGS

FIG. 5 is a fragmentary cross-sectional view of the car with portions broken away taken along the line 5—5 of FIG. 1.

FIG. 6 is a cross-sectional view of the car taken along the line 6—6 of FIG. 5.

FIG. 7 illustrates the wheels in phantom positions during turning.

FIG. 8 illustrates the wheels in phantom positions during turning, in a structural modification wherein the opening and its reinforcement have an other than circular periphery.

DETAILED DESCRIPTION OF THE INVENTION

Figure 1:
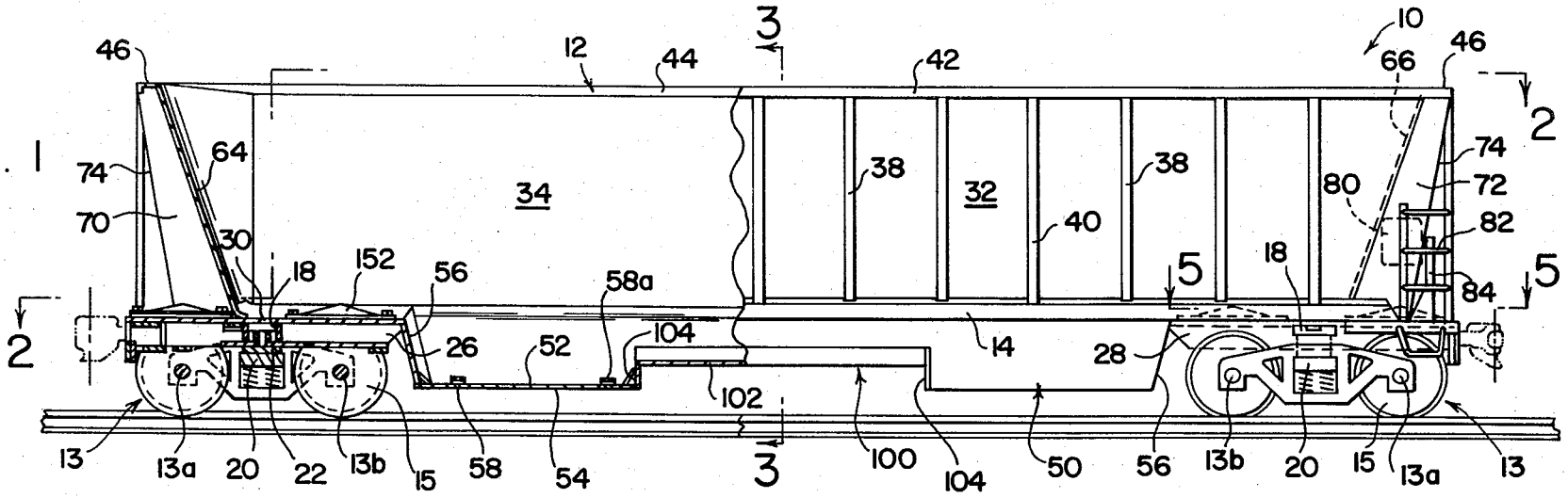
FIG. 1 is a side elevation partly in section and partly broken away of an open top gondola railway car of depressed center type embodying the invention.
Figure 2:
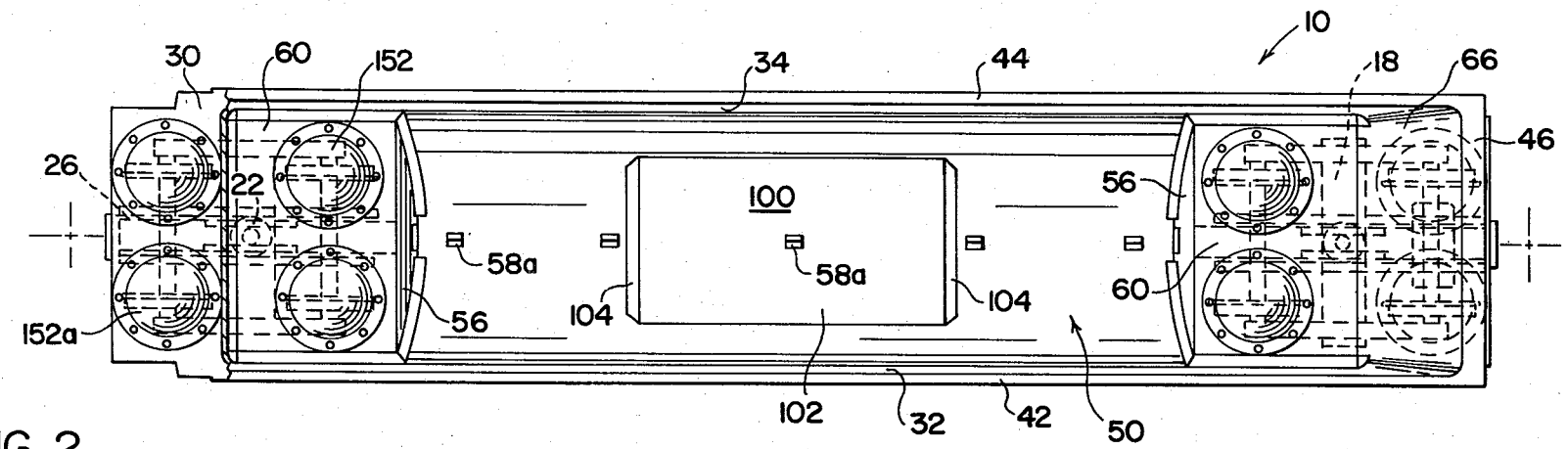
FIG. 2 is a cross-sectional view of the car taken along the line 2—2 of FIG. 1.
Figure 3:
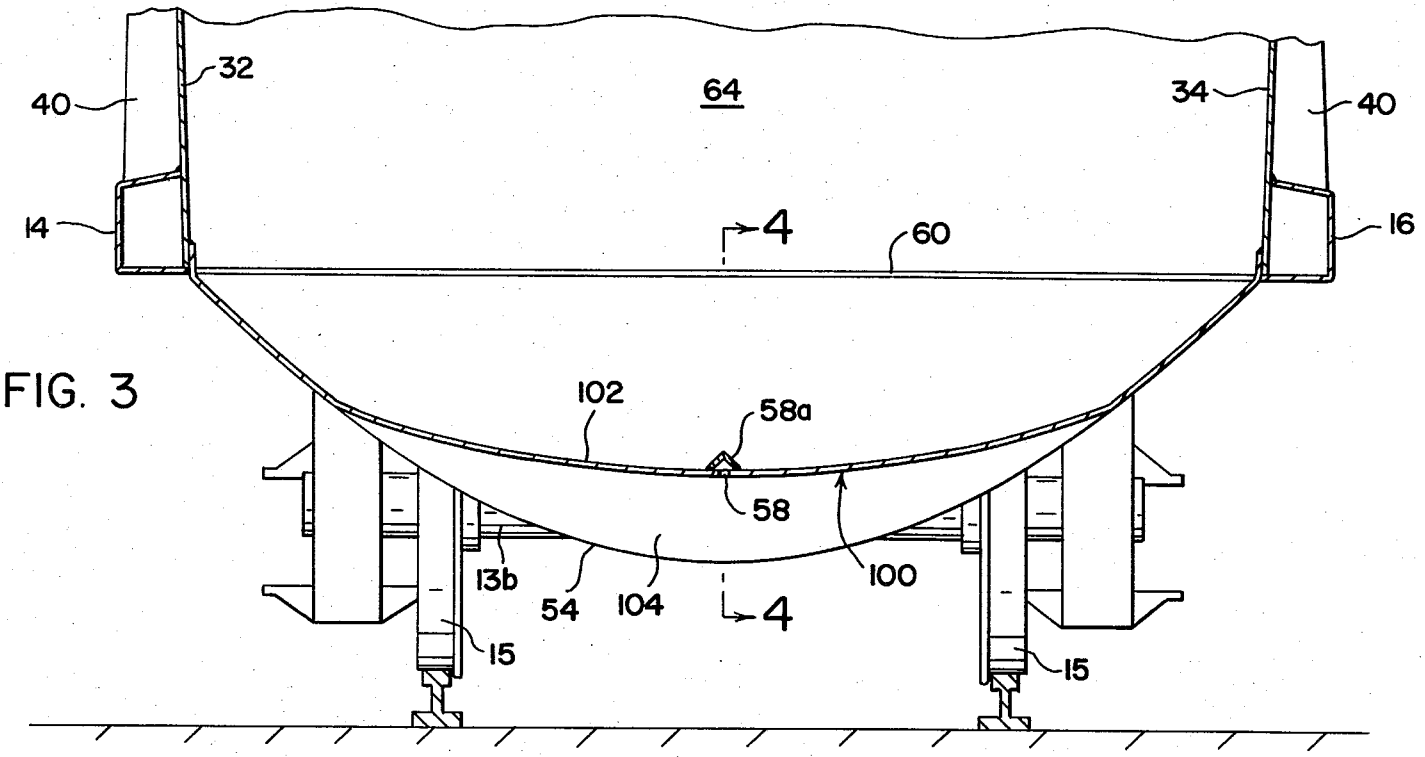
FIG. 3 is a cross-sectional view of the car taken along the line 3—3 of FIG. 1.
Figure 4:
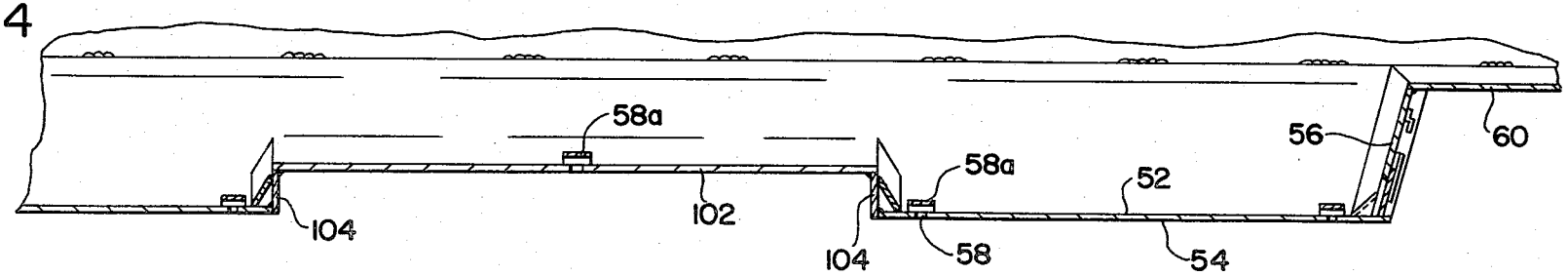
FIG. 4 is a fragmentary cross-sectional view of the car taken along the line 4—4 of FIG. 3.

The numeral 10 generally designates an open topped gondola railway car of depressed center or bathtub design constructed in accordance with the principles of this invention. The car 10 comprises a body portion generally designated 12 mounted on trucks at either end of the car generally designated by the numeral 13. Trucks 13 each have outer axles 13*a* and inner axles 13*b*.

The car body 12 has longitudinally running side sills 14 and 16 on respective sides of the car. The side sills 14 and 16 are the main longitudinal members of the car frame and are supported at either end by means of body bolsters 18. The body bolsters 18 are transverse members on the underside of the car body between and above the truck axle centers through which the lading weight is transmitted. Trucks 13 have transverse bolsters 20 in register with body bolsters 18. The body and truck bolsters 18 and 20 have mating center plates 22 such that the body bolster 18 rests on the center plate means 22 over truck bolster 20 and is connected to it by means of a center pin.

At the ends of the car and extending in either direction from the bolsters 18 and 20 are longitudinally oriented end stub center sills generally designated by the numerals 26 and 28. The end stub center sills 26 and 28, respectively, span the body and truck bolsters 18 and 20 and extend on either side thereof. A top cover plate or shear plate 30 is provided over the body bolster and center sill at each end.

The body 12 includes side panels 32 and 34 respectively, which are fastened to the side sills 14 and 16, as by welding. Vertical stiffening members 38 and vertical posts 40 extend between the side sills 14 and 16 respectively, and the side plates 42 and 44 respectively, which run longitudinally along the tops of the side panels 32 and 34, respectively. Side plates 42 and 44 are connected by transverse end plates 46 at each end of the car.

A depressed center portion of the body, generally designated by the numeral 50, extends downwardly from the side sills 14 and 16 respectively, and longitudinally between the trucks 13. The depressed center portion 50 is made up of sheets having, in cross-section, a generally curved or "parabolic" concave upper inner surface 52 and a convex lower outer surface 54. The term "parabolic" means a general curve having the described concave-convex inner and outer surfaces in cross-section such as does a parabola. No implication that an exact geometric parabola need be defined by the surfaces 52 and 54 is intended. The bottom depressed center portion 50 has appropriate end sheets 56 and drain openings 58 for the expelling of water. Covers 58*a* keep lading from clogging the drain openings 58.

Extending over the inner ends of the end stub center sills 26 and 28 are bottom portions 60 which are portions of horizontal or shear plates 30. Portions 60 extend from depressed center portion end plates 56 to an area between the axles of the trucks at which point they intersect with longitudinally outwardly and upwardly extending end panels 64 and 66. The end panels 64 and 66 extend all the way to the top of the car where they are joined to the end plates 46 at their respective ends and in so doing extend over or outside of the axles of the outermost wheel of their respective trucks in a manner which takes full advantage of the car length for lading and protects the brake apparatus and safety appliances.

The end panels 64 and 66 are supported by support sheets 70 and 72, respectively. The support sheets 70 and 72 each have a flange for stiffening as shown at 74 in FIG. 1, and they extend from the side plates 42 and 44 at the top of the car to the shear plate 30. The support sheets 70 and 72, along their inner edge, engage the end slope sheets 64 and 66 respectively. Thus the support sheets 70 and 72 transfer the downward moment of force exerted on the outwardly and upwardly sloping end panels 64 and 66 by the weight of the lading to the outer portions of the end stub sills 26 and 28, respectively.

The downward force transmitted from the end sheets 64 and 66 by means of the support sheets 70 and 72 acts on the outer portions of end stub sills 26 and 28, to counteract or balance tendencies of the end stub sills to pivot downwardly and inwardly about the center plates 22 because of lading forces exerted on bottom portions 60. This provides even loading on the center plates 22 and reduces wear and abnormal rocking and rolling motion.

The car 10 is provided with direct acting truck mounted brakes, and because of the area between the trucks being occupied by the depressed center portion 50 of the body, the brake reservoir and top valves are mounted on the car end as shown in FIG. 1 in phantom and are generally designated by the numeral 80. Also at the end of the car are certain safety appliances such as the ladder, generally designated by the numeral 82, and the hand brake and its stanchion, which are generally designated by the numeral 84. Thus the brake apparatus 80 and the safety appliances 82 and 84 are substantially covered and protected by the end panel 64 and the end plate 46 attached thereto, so that no additional overhanging roof, shell or other structure is necessary to protect them from damage during "flood" loading of the lading.

The depressed center portion 50, the end sheets 56 and horizontal plates 60 define a generally permanently closed bottom of car 10 having a stepped up portion intermediate its ends generally designated by the numeral 100. The stepped portion 100 extends longitudinally of the car along a portion of the depressed center portion 50 thereof. When viewed in cross-section transverse to the longitude of the car, the stepped portion 100 is defined by curved sheets 102. Sheets 102 have drain holes 58 in the same manner as do the sheets of depressed center portion 50. The sheets 102 are curved about a larger radius than the sheets that define the remainder of the depressed center portion 50. Accordingly, the stepped portion 100 is located a greater distance from the track upon which the car is located. As will be best seen in FIG. 9, this provides increased clearance for the depressed center portion of the car in travel over sections of the track which have severe convex contours. Appropriate end sheets 104 are provided to close the gap that would be created between the full sized sheets of the depressed center portion 50 and the sheets 102. Suitable reinforcing plates are provided at the welded joints therebetween.

Figure 9:
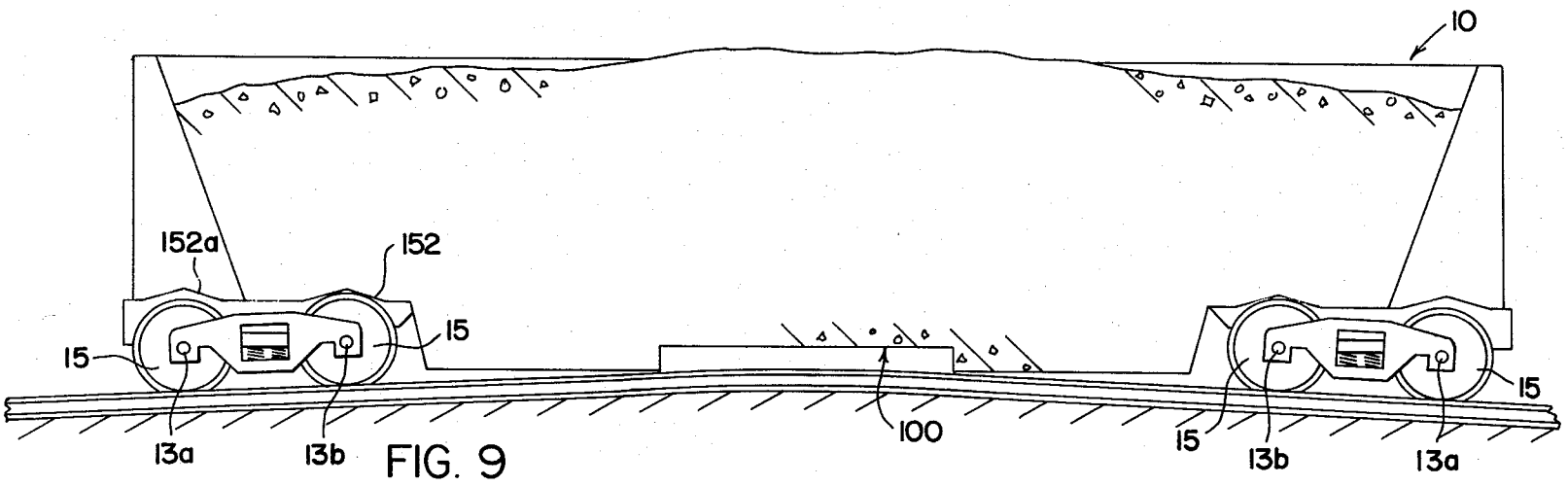
FIG. 9 illustrates a loaded depressed center open top gondola car constructed according to the principles of this invention passing over a length of track having an exaggerated convex contour.
Figure 10:
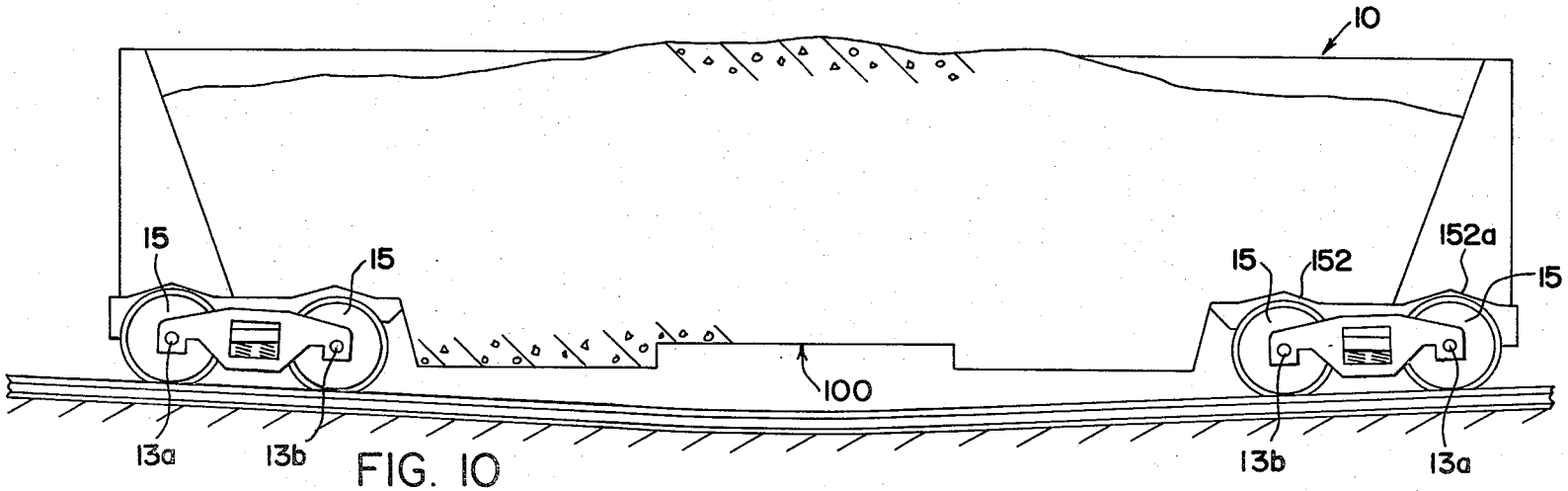
FIG. 10 is a view similar to FIG. 9 with the car passing over a length of track having an exaggerated concave contour.

As seen in FIGS. 9 and 10, for example, extra wheel clearance is provided in accordance with the novel combination of this invention by reinforced openings in the horizontal plate portions 60 of the bottom or shear plates 30. Accordingly, when a car is going over a severe convex contoured portion of track, as shown in FIG. 9, adequate clearance for the inner wheels of the trucks associated with axles **13*b* is provided. Moreover, when the car is going over a severe concave contoured portion of track as shown in FIG. 10, the outermost wheels of the trucks in association with axles 13*a*** are accommodated in openings.

FIGS. 5 through 8 show the structure of the reinforced openings. In FIG. 5 for example, a circular opening 150 is provided in horizontal shear plate 30 such that the flanged railway wheels 15 associated with axles **13*a* and 13*b* may extend up through the openings. When the railroad car 10 is located on a severely convex contoured track portion, as seen in FIG. 9, flanged wheels 15 of axle 13*b* extend upwardly beyond the plate 30 into a recess formed by conical opening reinforcing member 152. The conical opening member 152 has flanges 154 which are bolted as by high strength steel bolts and nuts thereby creating a friction type clamping means about the perimeter of the opening. It will be obvious in this regard that an annular ring without the conical portion could be utilized but it is preferred that, in the portion of the shear plate 30 acting as the bottom portion 60, the thicker gauged flanged conical member 152** be utilized.

As seen in FIG. 10, on the outer end of the shear plate over axles **13*a* an annular reinforcing ring 154*a* is provided for reinforcing and a thinner gauged conical non-load bearing dust cover 152*a* is provided. This is sufficient for the outer wheels since the wheels 15 associated with axle 13*a*** need not have a cover of strength sufficient to maintain the weight of the lading.

FIG. 7 illustrates in phantom various positions the wheel 15 takes relative to the reinforced opening **150*a*. In FIG. 8 it can be seen that an opening having a non-circular periphery could be provided in which case the reinforced opening 150*a* and its cover 152*b* illustrate but one form of opening which would be possible and which would accommodate the turning of the wheels as shown in phantom in that figure. The circular opening 150** with its annular cover, in addition to being easier to produce, however, also has been found to give a more even distribution of force in the shear plate and, accordingly, is a preferred embodiment.

Thus, it will be seen that an improved open top gondola car for use on track having severely convex contoured and severely concave contoured portions is provided according to the principles of this invention.

What is claimed is:

1. In an open top gondola railway car having a generally permanently closed bottom with horizontal plate portions and at least one depressed generally curved portion in cross-section, a plurality of drain holes in said curved portion and wheeled multi-axle trucks adjacent each end thereof, said horizontal plate portions of said bottom extending over wheels of said trucks and said curved portion of said bottom extending downwardly between said trucks, the improvement comprising:

an upwardly directed stepped portion intermediate the ends of said curved portion of said bottom, and openings having a smoothly curved perimeter in said horizontal plate portions over at least some wheels of said trucks so as to provide an increase in the clearance distance between said wheels and said plate portions during location of said car over any severe convex or concave contoured portions of track.

2. The open topped gondola railway car of claim 1 in which the horizontal plate portions include shear plates.

3. The open topped gondola railway car of claim 1 in which centrally located stub sills are provided longitudinally adjacent and outside either end of said depressed generally curved portion.

4. The open topped gondola railway car of claim 3 in which the car includes a body with sloped ends and support means directing lading forces exerted on said sloped ends to said stub sills.

5. The open topped gondola railway car of claim 1 in which the openings are circular.

6. The open topped gondola railway car of claim 1 in which said perimeter includes reinforcing means.

7. The open topped gondola railway car of claim 6 in which said perimeter reinforcing means is a friction type of clamping means secured with high strength steel bolts.

8. The open topped gondola railway car of claim 7 in which said friction type of clamping means defines a closed cover over the openings.

9. The open topped gondola railway car of claim 8 in which the cover is conical and has an annular flange.

* * * * *